US008708478B1

(12) United States Patent
Kobayashi et al.

(10) Patent No.: US 8,708,478 B1
(45) Date of Patent: Apr. 29, 2014

(54) METHOD FOR PRINTING ON A SHINY SURFACE BY A UV INKJET PRINTER WITH TRANSPARENCY AND HIGH COLOR DENSITY

(71) Applicants: Katsuragawa Electric Co., Ltd., Tokyo (JP); Great Computer Corporation, New Taipei (TW)

(72) Inventors: Takashi Kobayashi, Tokyo (JP); Naoki Nishiyama, Tokyo (JP); Chi-Hua Yen, New Taipei (TW); Chen-Chien Tsai, New Taipei (TW)

(73) Assignees: Katsuragawa Electric Co., Ltd., Tokyo (JP); Great Computer Corporation, New Taipei (TW)

( * ) Notice: Subject to any disclaimer, the term of this patent is extended or adjusted under 35 U.S.C. 154(b) by 20 days.

(21) Appl. No.: 13/648,425

(22) Filed: Oct. 10, 2012

(51) Int. Cl.
*B41J 2/01* (2006.01)

(52) U.S. Cl.
USPC ..... 347/102

(58) Field of Classification Search
USPC ..... 347/102, 103, 104, 105, 106, 155, 156
See application file for complete search history.

(56) References Cited

U.S. PATENT DOCUMENTS 7,216,417 B2 * 5/2007 Raisanen ..... 29/595
7,635,564 B2 * 12/2009 Corson ..... 435/6.18

* cited by examiner

*Primary Examiner* — Anh T. N. Vo
(74) *Attorney, Agent, or Firm* — Muncy, Geissler, Olds & Lowe, P.C.

(57) ABSTRACT

A method for printing on a shiny surface by a UV inkjet printer with transparency and high color density is described. Steps of the method include: (a) according to a conveying direction of a workpiece, dividing the workpiece with a reflective film into a plurality of continuous printing areas; (b) performing a printing operation on each printing area of the reflective film of the workpiece for at least three times; and (c) turning on a UV lamp at one side of an inkjet module when a final printing operation is performed on each printing area, to cure ink jetted from the inkjet module, thereby enabling the reflective film of the workpiece to still retain high shininess and high transparency after printing of the workpiece with a transparent reflective film surface is completed, and enabling a pattern printed thereon to have high color density.

22 Claims, 6 Drawing Sheets

METHOD FOR PRINTING ON A SHINY SURFACE BY A UV INKJET PRINTER WITH TRANSPARENCY AND HIGH COLOR DENSITY

BACKGROUND OF THE INVENTION

1. Field of the Invention

The present invention relates to a method for printing on a shiny surface by a UV inkjet printer with transparency and high color density, and more particularly to a method in which a printing operation is performed on a reflective film of a workpiece for at least three times, and the reflective film of the workpiece is enabled to retain high shininess, high transparency and high color density in a manner of delaying ink curing after completing the printing.

2. Related Art

A UV inkjet printer can print on multiple workpieces with different materials or thickness, besides providing a fast printing speed and achieving stable and consistent printing quality, the reliable performance of the UV inkjet printer can also save the time of the operation of manufacturing a color-separation screen, for a user to fast complete the printing, so that the UV inkjet printer brings about multiple economical and practical printing solutions and has a competitive advantage.

In a commercially available UV inkjet printer, mainly an inkjet module capable of being controlled to move back and forth is disposed on a sliding platform of a table, a plurality of ink cartridges is disposed above the inkjet module, and a plurality of inkjet heads corresponding to the ink cartridges is disposed below the inkjet module, in which the ink is jetted onto a workpiece to be printed through a nozzle at the bottom of an inkjet head, and then light of a UV lamp disposed at a side of the inkjet module is projected onto the ink jetted on the workpiece, so that the ink is fast cured and solidified. When the workpiece is printed, in the prior art, each area to be printed of the workpiece is printed in a unidirectional manner once, or in a bidirectional manner back and forth, so as to shorten the printing time.

However, after the UV inkjet printer prints a pattern on a workpiece with a transparent reflective film surface, shininess and transparency of the reflective film of the workpiece are dramatically reduced, and color density of the pattern printed on the reflective film of the workpiece is low, resulting in that the pattern printed on the workpiece with a transparent reflective film surface by the UV inkjet printer has undesirable quality. Therefore, to solve the disadvantage, in a conventional process, a cutter cuts a required pattern from a colored transparent film, and then the cut colored transparent film is stuck onto the reflective film of the workpiece, so as to form the required pattern on the reflective film of the workpiece. However, this method has complicated steps, and relatively causes problems of high cost and low yield.

In view of this, to solve the above disadvantage, and in order that, through a method for printing on a shiny surface by a UV inkjet printer with transparency and high color density, after the printing is completed on a workpiece with a transparent reflective film surface, the workpiece of reflective film is still enabled to retain a surface with high shininess and high transparency, and a pattern printed on such a surface is provided with high color density, through years of experience and continuous R&D and improvement, the inventors present the present invention.

SUMMARY OF THE INVENTION

A main objective of the present invention is to provide a method for printing on a shiny surface by a UV inkjet printer with transparency and high color density. A printing operation is performed on each printing area of a reflective film of a workpiece for at least three times, and a UV lamp at one side of an inkjet module is turned on at the same time when a final printing operation is performed on each printing area, so as to cure the ink jetted from the inkjet module, so that the reflective film of the workpiece still has high shininess, high transparency and high color density after the completion of the printing, thereby dramatically improving printing quality on the workpiece with the reflective film, reducing the cost and improving the working efficiency.

Another objective of the present invention is to provide a method for printing on a shiny surface by a UV inkjet printer with transparency and high color density. A printing operation is performed on each printing area of a reflective film of a workpiece for at least three times, UV lamps are turned off first when the printing operation on a first printing area is completed, and a UV lamp at one side of an inkjet module is turned on at the same time when a first printing operation is performed on every next printing area, so as to cure the ink jetted from the inkjet module, so that the reflective film of the workpiece still has high shininess, high transparency and high color density after the completion of the printing, thereby dramatically improving printing quality on the workpiece with the reflective film, reducing the cost and improving the working efficiency.

To achieve the above objectives, a method for printing on a shiny surface by a UV inkjet printer with transparency and high color density according to the present invention includes the following steps:

(a) according to a conveying direction of a workpiece, dividing the workpiece with a reflective film into a plurality of continuous printing areas;

(b) performing a printing operation on each printing area of the reflective film of the workpiece for at least three times; and (c) turning on a UV lamp at one side of an inkjet module when a final printing operation is performed on each printing area, to cure ink jetted from the inkjet module.

In the implementation, in step (b), a moving direction of a final printing operation on each printing area is contrary to a moving direction of a first printing operation on a next printing area, and the UV lamp turned on is a UV lamp disposed at one side of the inkjet module back on to the printing direction.

In the implementation, in step (b), when the printing operation is performed on each printing area for three times, the first printing operation is performed at the same printing speed with that of the second printing operation, while the final printing operation is performed at a printing speed lower than that of the first printing operation.

In the implementation, in step (b), when the printing operation is performed on each printing area for three times, the first printing operation is performed at the same printing speed with that of the final printing operation, while the second printing operation is performed at a printing speed lower than that of the first printing operation.

In the implementation, in step (c), the UV lamps at two sides of the inkjet module are alternatively turned on, so that in a final printing operation on each printing area and a final printing operation on a next printing area, the UV lamps at different sides are used to cure the ink.

In the implementation, the inkjet module is disposed with a plurality of cartridges for the ink of each color to be stored in two of the cartridges, and the two cartridges are arranged symmetrically about a center line of the inkjet module.

In a second embodiment of the present invention, a method for printing on a shiny surface by a UV inkjet printer with transparency and high color density according to the present invention includes the following steps:

(a') according to a conveying direction of a workpiece, dividing the workpiece with a reflective film into a plurality of continuous printing areas;

(b') performing a printing operation on each printing area of the reflective film of the workpiece for at least three times; and (c') turning on a UV lamp at one side of an inkjet module when a first printing operation is performed on a next printing area, to cure ink jetted from the inkjet module.

In the implementation of the second embodiment, in step (b'), a moving direction of a final printing operation on each printing area is contrary to a moving direction of a first printing operation on a next printing area, and the UV lamp turned on is a UV lamp disposed at one side of the inkjet module facing the printing direction.

In the implementation of the second embodiment, in step (c'), after the final printing operation is completed on a final printing area, the inkjet module spans the workpiece in a direction contrary to a moving direction of the final printing operation in a state of stopping jetting the ink, and the UV lamp disposed at one side of the inkjet module facing the moving direction is turned on to cure the ink.

In the implementation of the second embodiment, in step (b'), when the printing operation is performed on each printing area for three times, the first printing operation is performed at the same printing speed with that of the second printing operation, while the final printing operation is performed at a printing speed lower than that of the first printing operation.

In the implementation of the second embodiment, in step (b'), when the printing operation is performed on each printing area for three times, the first printing operation is performed at the same printing speed with that of the final printing operation, while the second printing operation is performed at a printing speed lower than that of the first printing operation.

In the implementation of the second embodiment, in step (c'), the UV lamps at two sides of the inkjet module are alternatively turned on, and for adjacent printing areas, UV lamps at different sides of the inkjet module are alternatively used to cure the ink.

In the implementation of the second embodiment, in step (c'), the UV lamps are turned off first when the printing operation on the first printing area is completed, and then a printing operation is performed on a next printing area.

In a third embodiment of the present invention, a method for printing on a shiny surface by a UV inkjet printer with transparency and high color density according to the present invention includes the following steps:

(a") according to a conveying direction of a workpiece, dividing the workpiece with a reflective film into a plurality of continuous printing areas;

(b") enabling an inkjet module to perform a printing operation on each printing area of the reflective film of the workpiece for three times; and (c") after completing a final printing operation on each printing area, enabling the inkjet module to span the workpiece in a direction contrary to a moving direction of the final printing operation in a state of stopping jetting the ink, and turning on a UV lamp disposed at one side of the inkjet module back on to the moving direction, so as to cure the ink jetted from the inkjet module.

To further understand the present invention, the specific content and the effect of the present invention are described in detail in the following with reference to the preferred embodiments, drawings and drawing numbers.

DETAILED DESCRIPTION OF THE INVENTION

Figure 1A:
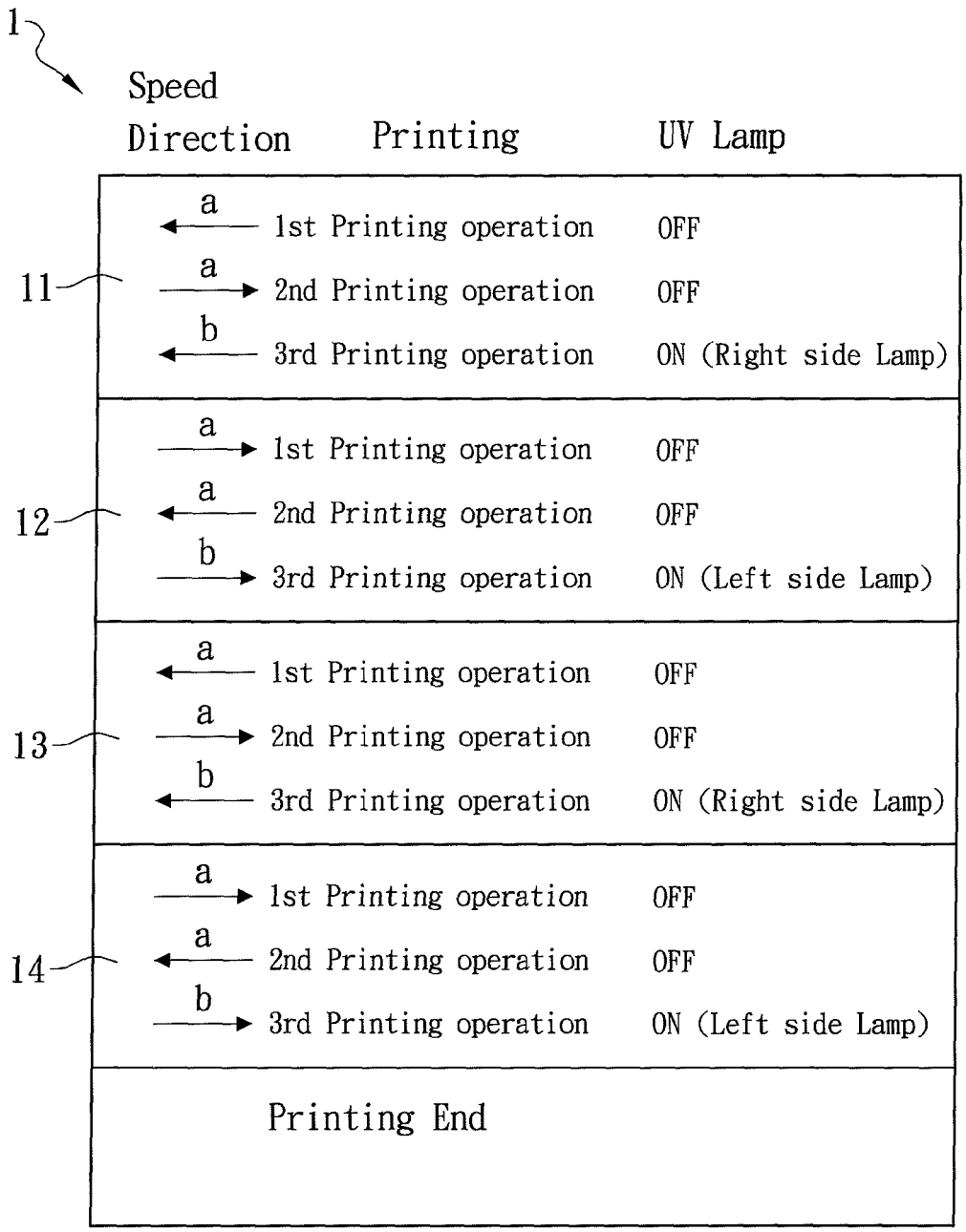
FIGS. 1A and 1B are a schematic architecture view of a first embodiment of the present invention.
Figure 1B:
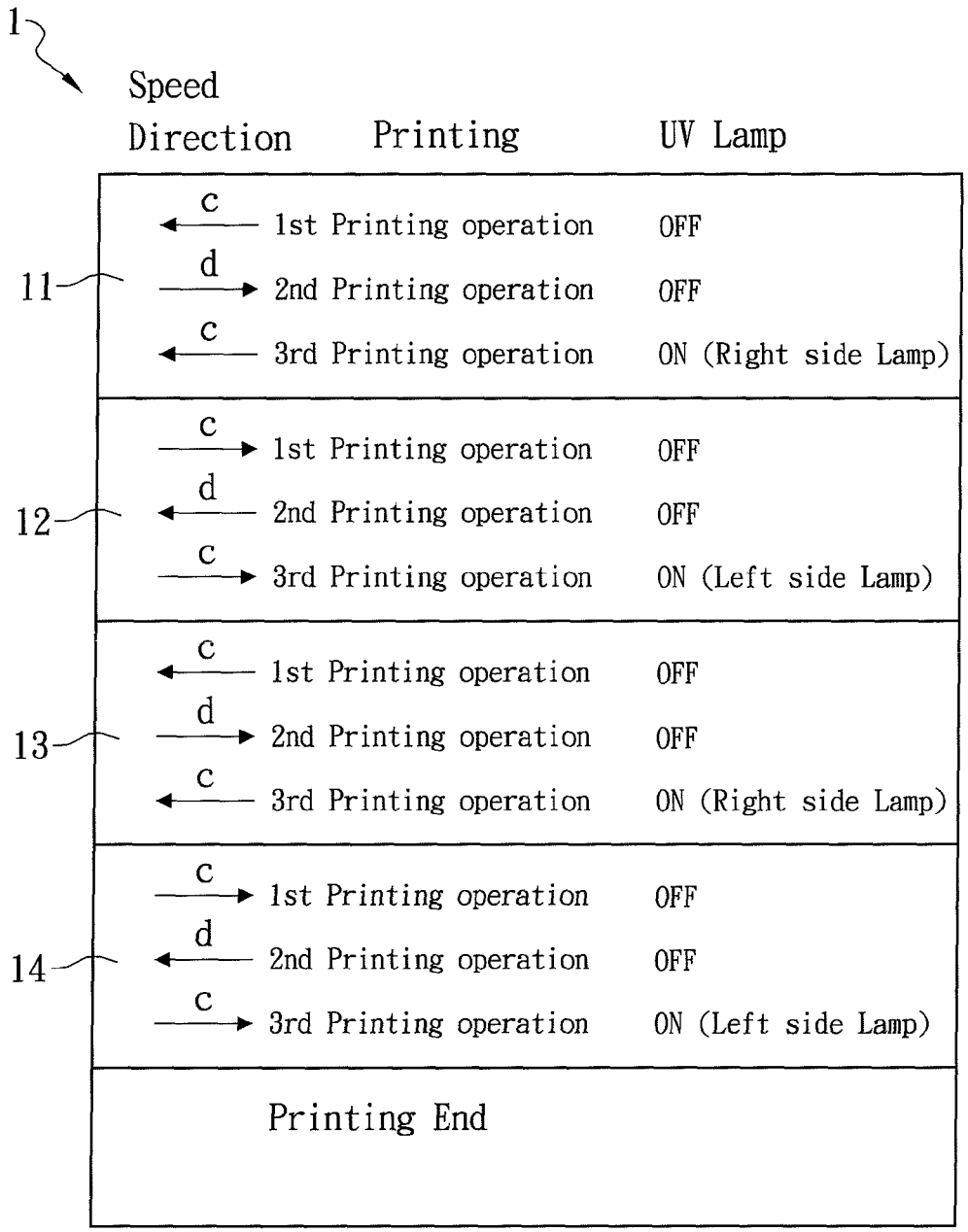
Figure 2:
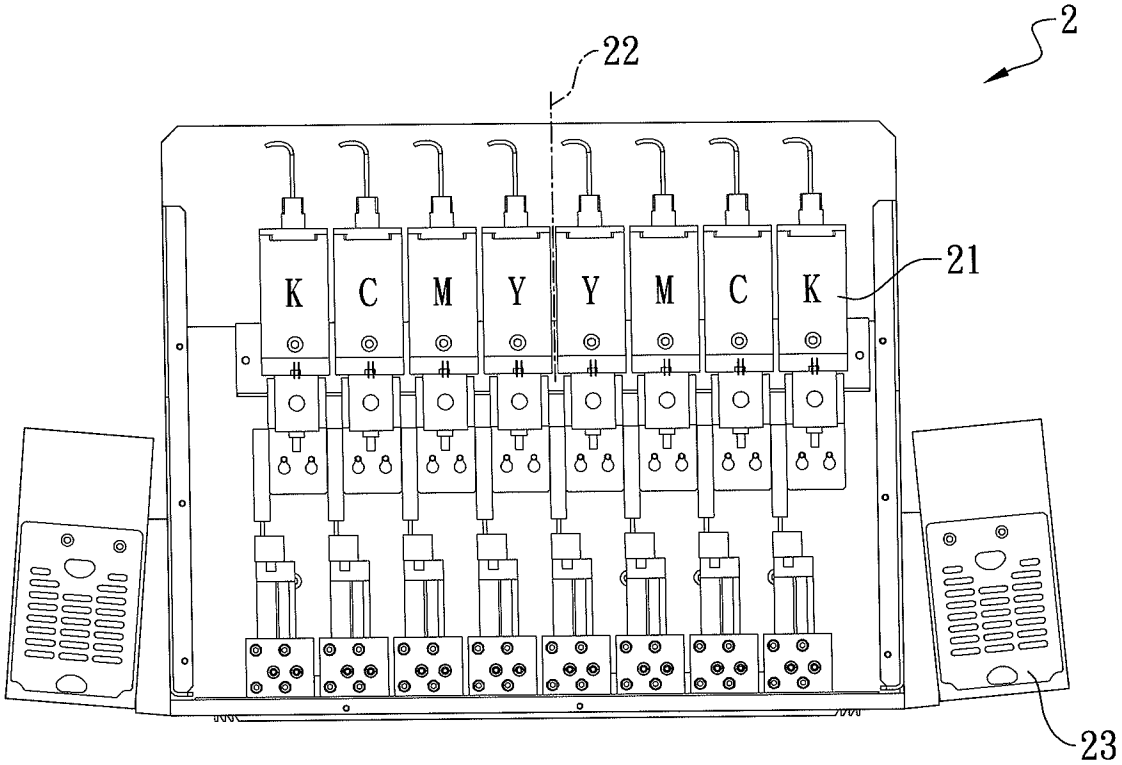
FIG. 2 is a schematic architecture view of the inkjet module in the first embodiment of the present invention.

Referring to FIG. 1, a schematic view of operation architecture of a first embodiment of a method for printing on a shiny surface by a UV inkjet printer with transparency and high color density according to the present invention is shown, in which the inkjet module 2 is disposed with a plurality of cartridges (as shown in FIG. 2), and the ink of each color is stored in two of those cartridges 21, and the two cartridges 21 with the same color are arranged symmetrically about a center line 22 of the inkjet module 2. The color arrangement order of the cartridges in the inkjet module 2 is K (black), C (cyan), M (magenta), Y (yellow), Y, M, C, K. Further, a UV lamp 23 is separately disposed at each of two sides of the inkjet module 2. The method moves the inkjet module 2 back and forth to perform the printing operation by the following steps:

(a) according to a conveying direction of a workpiece, dividing the workpiece with a reflective film into a plurality of continuous printing areas;

(b) performing a printing operation on each printing area of the reflective film of the workpiece for three times; and (c) turning on a UV lamp at one side of an inkjet module when a final printing operation is performed on each printing area, to cure ink jetted from the inkjet module.

A surface of the workpiece 1 has a transparent reflective film (not shown) provided for the inkjet module to jet the ink thereon. Moreover, according to a conveying direction of the vertically forwarding workpiece 1, the UV inkjet printer divides the workpiece 1 into a plurality of continuous printing areas (11, 12, 13, and 14), and moves horizontally back and forth to perform the printing operation on each printing area of the reflective film of the workpiece 1 for three times, so that a moving direction of a final printing operation on each printing area performed by the inkjet module is contrary to a moving direction of a first printing operation on a next printing area.

When the inkjet module of the UV inkjet printer performs the final printing operation on each printing area, a UV lamp disposed at one side of the inkjet module back on to the printing direction is turned on, so as to cure the ink jetted from the inkjet module. Taking a printing area 11 as an example, the inkjet module performs the printing operation back and forth from left to right for three times on the printing area 11 with the same image printing information, in which, during the first and the second printing operations, the UV lamp is turned off when the printing is performed sequentially leftwards and rightwards, while during the third printing operation, the printing is performed leftwards, and a UV lamp at a right side of the inkjet module is turned on during the printing, so as to cure the ink jetted onto the printing area 11. After the printing operation performed for three times on the printing area 11 is completed, then the UV inkjet printer moves the workpiece 1 forward, so that a printing area 12 of the workpiece 1 is moved to a lower portion of the inkjet module for printing. Correspondingly, in the third printing operation on the printing area 12, the printing is performed rightwards, and a UV lamp at a left side of the inkjet module is turned on during the printing, so as to cure the ink jetted onto the printing area 12. Therefore, for adjacent printing areas of the workpiece 1, the UV lamps at the left and the right sides of the inkjet module are alternatively turned on, so that in the final printing operations on the adjacent printing areas, the UV lamps at different sides are used to cure the ink.

In this embodiment, the first printing operation on each printing area is performed at the same printing speed a with that of the second printing operation, while the third (final) printing operation is performed at a printing speed b lower than that of the first printing operation. In addition, the printing speed of the printing operation performed for three times on each printing area may also be set that, the first printing operation is performed at the same printing speed c with that of the third (final) printing operation, while the second printing operation is performed at a printing speed d lower than that of the first printing operation. Since the cartridges 21 storing the same color of ink is arranged symmetrically about the center line 22 of the inkjet module 2, in the case that two different colors of inks (such as colors of yellow and cyan) are set to be jetted on the same position of the workpiece, the yellow and cyan would be sequentially jetted by activating the yellow and cyan cartridges on the left side of the center line when the inkjet module moves in the left to right direction, and the yellow and cyan would also be sequentially jetted by activating the yellow and cyan cartridges on the right side of the center line when the inkjet module moves in the right to left direction. Therefore, the inkjet module could sequentially jet the yellow and cyan inks on the same position of the workpiece in the left/right direction.

Figure 3A:
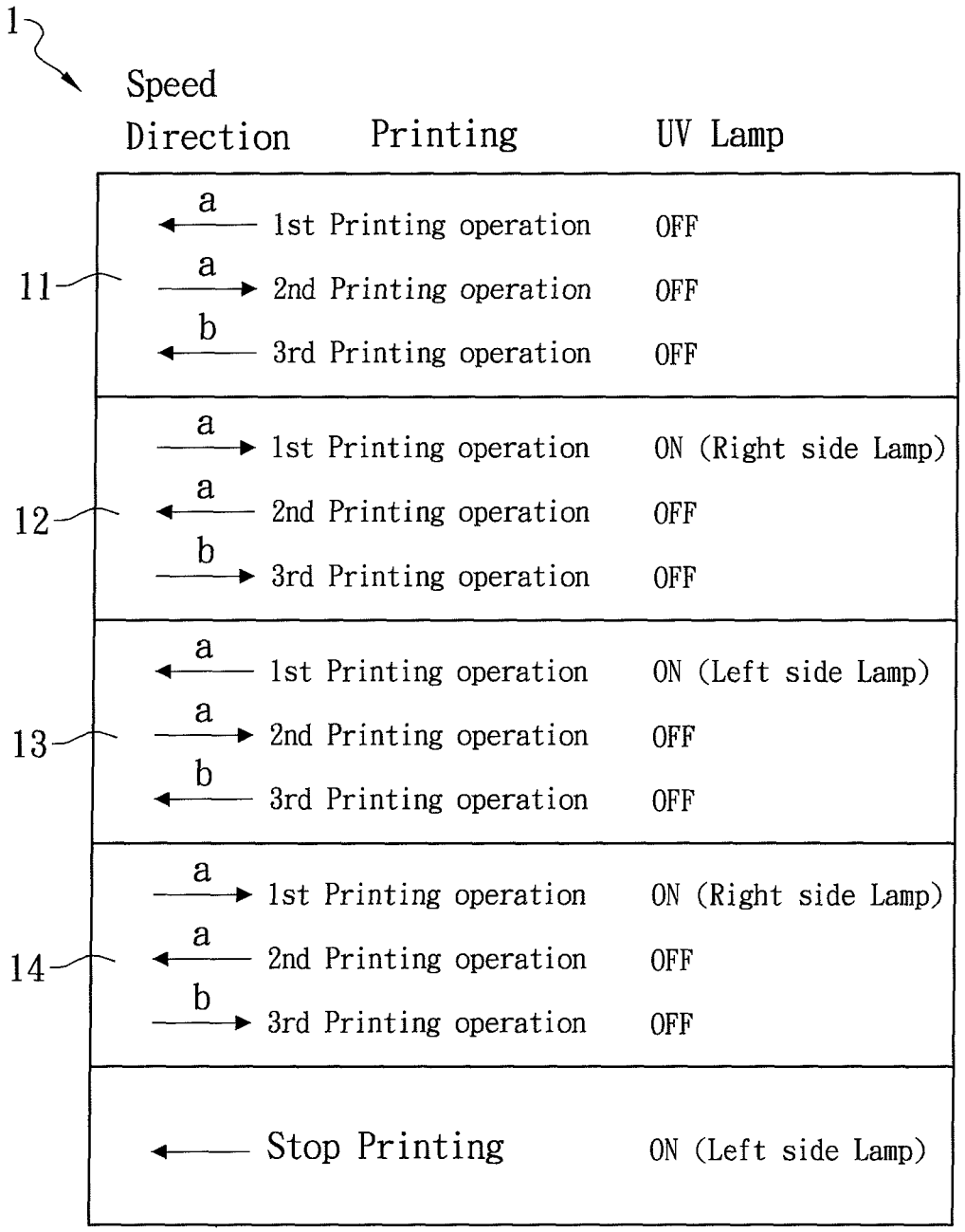
FIGS. 3A and 3B are a schematic architecture view of a second embodiment of the present invention.
Figure 3B:
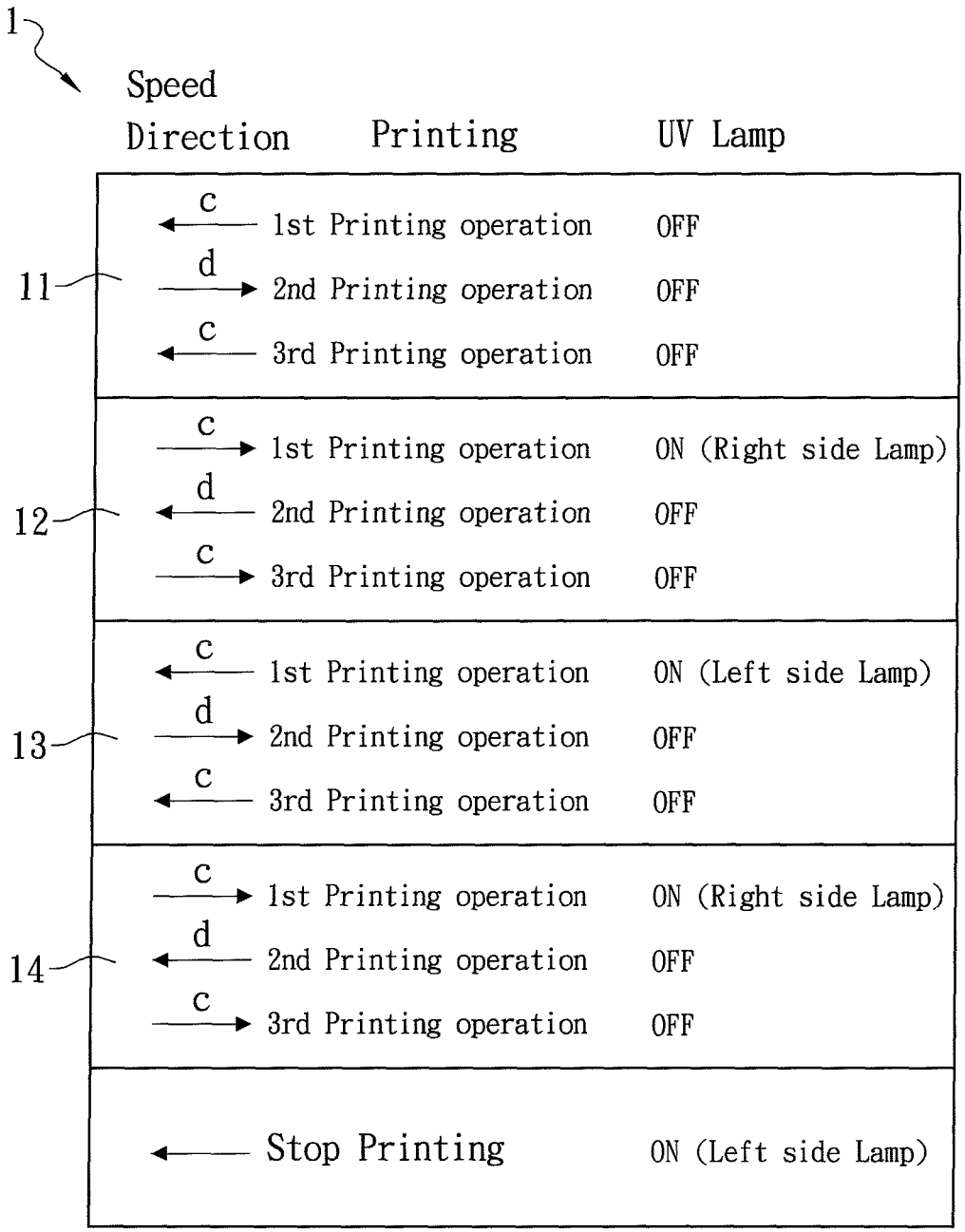

Referring to FIGS. 3A and 3B, a schematic view of operation architecture of a second embodiment of a method for printing on a shiny surface by a UV inkjet printer with transparency and high color density according to the present invention is shown, which is based on the architecture of the first embodiment and includes the following steps:

(a') according to a conveying direction of a workpiece, dividing the workpiece with a reflective film into a plurality of continuous printing areas;

(b') performing a printing operation on each printing area of the reflective film of the workpiece for three times; and (c') turning on a UV lamp at one side of an inkjet module when a first printing operation is performed on a next printing area, to cure ink jetted from the inkjet module.

A surface of the workpiece 1 has a transparent reflective film (not shown) provided for the inkjet module to jet the ink thereon. Moreover, according to a conveying direction of the vertically forwarding workpiece 1, the UV inkjet printer divides the workpiece 1 into a plurality of continuous printing areas (11, 12, 13, and 14), and performs the printing operation horizontally back and forth on each printing area of the reflective film of the workpiece 1 for three times, so that a moving direction of a final printing operation on each printing area performed by the inkjet module is contrary to a moving direction of a first printing operation on a next printing area.

When the inkjet module of the UV inkjet printer performs the printing operation on the printing area 11, the inkjet module first performs the printing operation back and forth from left to right for three times on the printing area 11 with the same image printing information in the state that the UV lamp is turned off. After the printing operations performed for three times on the printing area 11 are completed, the UV inkjet printer moves the workpiece 1 forward, so that a printing area 12 of the workpiece 1 is moved to a lower portion of the inkjet module for printing. When the first printing operation is performed on the printing area 12, the inkjet module moves rightwards, and a UV lamp disposed at a right side of the inkjet module is turned on, so as to cure the ink jetted from the inkjet module; afterwards, the inkjet module performs the second and the third printing operations on the printing area 12 sequentially leftwards and rightwards in the state that the UV lamp is turned off. When the printing operations performed for three times on a next printing area (the printing area 13) are performed, same as the printing operations on the printing area 12, when the first printing operation is performed on the printing area 12, a UV lamp disposed at a side (a left side) of the inkjet module facing the printing direction is turned on, so as to cure the ink jetted from the inkjet module, and then the second and the third printing operations on the printing area 12 are performed sequentially rightwards and leftwards in the state that the UV lamp is turned off. Therefore, for the printing areas 12, 13 and 14 of the workpiece 1, the UV lamps at the left and the right sides of the inkjet module are alternatively turned on, so that in the first printing operations on the adjacent printing areas, the UV lamps at different sides are used to cure the ink.

Afterwards, when the final printing operation on the final printing area (the printing area 14) of the workpiece 1 is completed, the UV inkjet printer is enabled to stop moving the workpiece 1, the inkjet module is enabled to move leftwards and spans the workpiece 1 in a direction contrary to a moving direction (rightwards) of the final printing operation in the state of stopping jetting the ink, and a UV lamp at a left side of the inkjet module facing the moving direction is turned on during the spanning, so as to cure the ink.

Likewise, in this embodiment, the first printing operation on each printing area is performed at the same printing speed a with that of the second printing operation, while the third (final) printing operation is performed at a printing speed b lower than that of the first printing operation. In addition, the printing speed of the printing operations performed for three times on each printing area may also be set that, the first printing operation is performed at the same printing speed c with that of the third (final) printing operation, while the second printing operation is performed at a printing speed d lower than that of the first printing operation.

Figure 4:
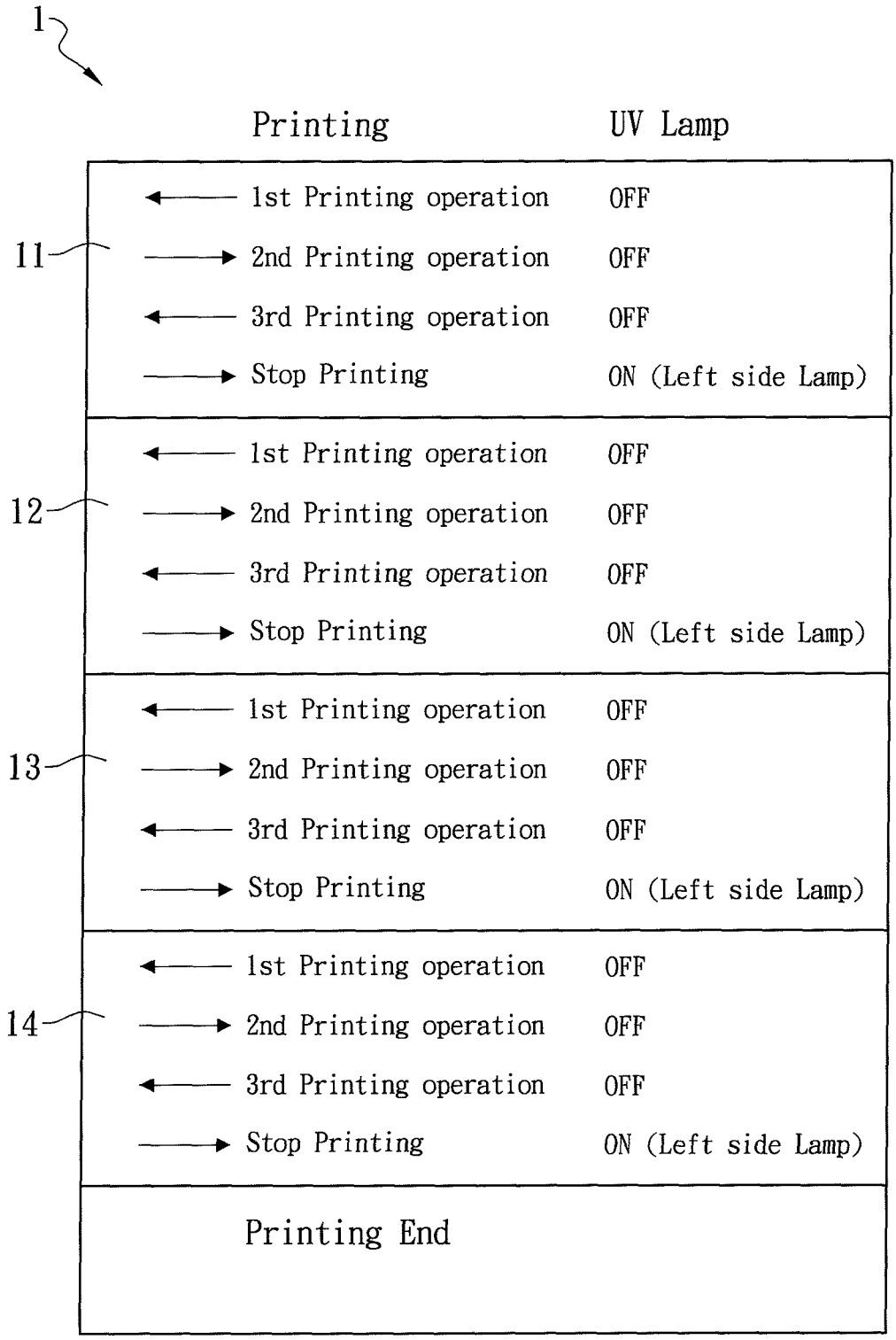
FIG. 4 is a schematic architecture view of a third embodiment of the present invention.

Referring to FIG. 4, a schematic view of operation architecture of a third embodiment of a method for printing on a shiny surface by a UV inkjet printer with transparency and high color density according to the present invention is shown, which is based on the architecture of the first embodiment and includes the following steps:

(a") according to a conveying direction of a workpiece, dividing the workpiece with a reflective film into a plurality of continuous printing areas;

(b") enabling an inkjet module to perform a printing operation on each printing area of the reflective film of the workpiece for three times; and (c") after completing a final printing operation on each printing area, enabling the inkjet module to span the workpiece in a direction contrary to a moving direction of the final printing operation in a state of stopping jetting the ink, and turning on a UV lamp disposed at one side of the inkjet module back on to the moving direction, so as to cure the ink jetted from the inkjet module.

When the inkjet module of the UV inkjet printer performs the printing operation on the printing area 11, the inkjet module first performs the printing operation back and forth from left to right for three times on the printing area 11 with the same image printing information in the state that the UV lamp is turned off. After the printing operation performed for three times on the printing area 11 is completed, the UV inkjet printer enables the inkjet module to span the workpiece rightwards in a direction contrary to a moving direction of the final printing operation in a state of stopping jetting the ink, and a UV lamp disposed at one side (a left side) of the inkjet module back on to the moving direction is turned on, so as to cure the ink jetted from the inkjet module. Afterwards, the workpiece 1 is moved forward, so that the printing area 12 of the workpiece 1 is moved to a lower portion of the inkjet module for printing, and the above steps are repeated till the printing on all the printing areas is completed. Therefore, for each of the printing areas 11, 12, 13 and 14 of the workpiece 1, the UV lamp at a left side of the inkjet module is used by the inkjet module to cure the ink jetted on the printing area after all the printing operations on each printing area are completed.

Through the above embodiments, the transparent reflective film on a surface of the workpiece 1 is enabled to still have high shininess, high transparency and high color density after the UV inkjet printer completes the printing, so as to ensure the printing quality.

Therefore, the present invention has the following advantages.

1. The present invention overturns a conventional idea that the ink increase will reduce the shininess and transparency of the reflective film of the workpiece, the printing operation is performed on each printing area of the workpiece for more than three times, in which the printing operations include at least one back-and-forth printing operation, the printing speed of the printing operations is adjusted, and the ink curing is delayed by turning on/off the UV lamps, so that the transparent reflective film on the surface of the workpiece still has high shininess, high transparency and high color density after the UV inkjet printer completes the printing, thereby dramatically improving the printing quality on the workpiece with the reflective film, reducing the cost and improving the working efficiency.

2. The present invention may be directly applied to UV inkjet printers of various types, so as to improve practicability and product competitiveness of the UV inkjet printers.

To sum up, according to the content disclosed in the specification, the present invention can definitely achieve the intended purposes, and provides a method for printing on a shiny surface by a UV inkjet printer with transparency and high color density in which the transparent reflective film on the surface of the workpiece is enabled to still retain a surface with high shininess and high transparency after the printing is completed, and a pattern printed thereon is enabled to have high color density, and the present invention has a utilization value in the industry, so the patent application is filed according to the laws.

What is claimed is:

1. A method for printing on a shiny surface by a UV inkjet printer with transparency and high color density, wherein an inkjet module of the UV inkjet printer moves back and forth to perform a printing operation, and a UV lamp is separately disposed at each of two sides of the inkjet module, the method comprising:

(a) according to a conveying direction of a workpiece, dividing the workpiece with a reflective film into a plurality of continuous printing areas;

(b) performing a printing operation on each printing area of the reflective film of the workpiece for at least three times; and (c) turning on a UV lamp at one side of the inkjet module when a final printing operation is performed on each printing area, to cure ink jetted from the inkjet module.

2. The method according to claim 1, wherein in step (b), a moving direction of a final printing operation on each printing area is contrary to a moving direction of a first printing operation on a next printing area.

3. The method according to claim 2, wherein the UV lamp turned on is a UV lamp disposed at one side of the inkjet module back on to a printing direction.

4. The method according to claim 3, wherein in step (b), a printing operation is performed on each printing area for three times, and a first printing operation is performed at the same printing speed with that of a second printing operation.

5. The method according to claim 4, wherein a final printing operation is performed at a printing speed lower than that of the first printing operation.

6. The method according to claim 3, wherein in step (b), a printing operation is performed on each printing area for three times, and a first printing operation is performed at the same printing speed with that of a final printing operation.

7. The method according to claim 6, wherein a second printing operation is performed at a printing speed lower than that of the first printing operation.

8. The method according to claim 1, wherein in step (c), UV lamps at two sides of the inkjet module are alternatively turned on, so that in a final printing operation on each printing area and a final printing operation on a next printing area, the UV lamps at different sides are used to cure the ink.

9. The method according to claim 1, wherein the inkjet module is disposed with a plurality of cartridges for an ink of each color to be stored in two of the cartridges, and the two cartridges are arranged symmetrically about a center line of the inkjet module.

10. A method for printing on a shiny surface by a UV inkjet printer with transparency and high color density, wherein an inkjet module of the UV inkjet printer moves back and forth to perform a printing operation, and a UV lamp is separately disposed at each of two sides of the inkjet module, the method comprising:

(a') according to a conveying direction of a workpiece, dividing the workpiece with a reflective film into a plurality of continuous printing areas;

(b') performing a printing operation on each printing area of the reflective film of the workpiece for at least three times; and (c') turning on a UV lamp at one side of the inkjet module when a first printing operation is performed on a next printing area, to cure ink jetted from the inkjet module.

11. The method according to claim 10, wherein in step (b'), a moving direction of a final printing operation on each printing area is contrary to a moving direction of a first printing operation on a next printing area.

12. The method according to claim 11, wherein the UV lamp turned on is a UV lamp disposed at one side of the inkjet module facing a printing direction.

13. The method according to claim 12, wherein in step (b'), a printing operation is performed on each printing area for three times, and a first printing operation is performed at the same printing speed with that of a second printing operation.

14. The method according to claim 13, wherein a final printing operation is performed at a printing speed lower than that of the first and the second printing operations.

15. The method according to claim 12, wherein in step (b'), a printing operation is performed on each printing area for three times, and a first printing operation is performed at the same printing speed with that of a final printing operation.

16. The method according to claim 15, wherein a second printing operation is performed at a printing speed lower than that of the first printing operation.

17. The method according to claim 10, wherein in step (c'), after a final printing operation is completed on a final printing area, the inkjet module is enabled to span the workpiece in a direction contrary to a moving direction of the final printing operation in a state of stopping jetting the ink, and a UV lamp disposed at one side of the inkjet module facing the moving direction is turned on to cure the ink.

18. The method according to claim 10, wherein in step (c'), UV lamps at two sides of the inkjet module are alternatively turned on, and for adjacent printing areas, the UV lamps at different sides of the inkjet module are alternatively used to cure the ink.

19. The method according to claim 10, wherein in step (c'), a printing operation on a first printing area is completed first in a manner of turning off the UV lamp, and then a printing operation is performed on a next printing area.

20. The method according to claim 10, wherein the inkjet module is disposed with a plurality of cartridges for an ink of each color to be stored in two of the cartridges, and the two cartridges are arranged symmetrically about a center line of the inkjet module.

21. A method for printing on a shiny surface by a UV inkjet printer with transparency and high color density, wherein an inkjet module of the UV inkjet printer moves back and forth to perform a printing operation, and a UV lamp is separately disposed at each of two sides of the inkjet module, the method comprising:

(a") according to a conveying direction of a workpiece, dividing the workpiece with a reflective film into a plurality of continuous printing areas;

(b") enabling an inkjet module to perform a printing operation on each printing area of the reflective film of the workpiece for three times; and (c") after completing a final printing operation on each printing area, enabling the inkjet module to span the workpiece in a direction contrary to a moving direction of the final printing operation in a state of stopping jetting ink, and turning on a UV lamp disposed at one side of the inkjet module back on to the moving direction, so as to cure the ink jetted from the inkjet module.

22. The method according to claim 21, wherein the inkjet module is disposed with a plurality of cartridges for an ink of each color to be stored in two of the cartridges, and the two cartridges are arranged symmetrically about a center line of the inkjet module.

* * * * *